US011480343B2

(12) United States Patent
Johnson et al.

(10) Patent No.: US 11,480,343 B2
(45) Date of Patent: Oct. 25, 2022

(54) OVEN APPLIANCE EQUIPPED WITH MULTIPLE FANS FOR SELECTING CONVECTION AIR FLOW DIRECTION

(71) Applicant: Haier US Appliance Solutions, Inc., Wilmington, DE (US)

(72) Inventors: Eric Scott Johnson, Louisville, KY (US); Yoel Tanquero, Miami Lakes, FL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 330 days.

(21) Appl. No.: 16/598,296

(22) Filed: Oct. 10, 2019

(65) Prior Publication Data

US 2021/0108803 A1 Apr. 15, 2021

(51) Int. Cl.

| | |
|---|---|
| ***F24C 15/32*** | (2006.01) |
| ***F24C 7/08*** | (2006.01) |
| ***F24C 7/00*** | (2006.01) |

(52) U.S. Cl.

CPC ..... *F24C 15/325* (2013.01); *F24C 7/00* (2013.01); *F24C 7/08* (2013.01)

(58) Field of Classification Search

CPC ..... F24C 15/325; F24C 7/00; F24C 7/08

See application file for complete search history.

(56) References Cited

U.S. PATENT DOCUMENTS

| | | | | |
|---|---|---|---|---|
| 2,873,908 | A * | 2/1959 | Powers | F24F 1/0284 55/467 |
| 7,183,520 | B2 * | 2/2007 | Park | H05B 6/6426 219/394 |
| 8,350,192 | B2 | 1/2013 | Phillips et al. | |
| 8,461,488 | B2 * | 6/2013 | Jeong | F24C 15/325 219/400 |
| 10,928,073 | B2 * | 2/2021 | Jeon | A21B 1/26 |
| 2003/0000515 | A1 * | 1/2003 | Cole | A21B 1/26 126/21 A |
| 2013/0284161 | A1 | 10/2013 | Johnson | |
| 2020/0191450 | A1 * | 6/2020 | Ladner | F25B 21/02 |

FOREIGN PATENT DOCUMENTS

| | | | | |
|---|---|---|---|---|
| EP | 3425286 | A1 | 1/2019 | |
| EP | 3772621 | A1 * | 2/2021 | F24C 15/325 |

* cited by examiner

*Primary Examiner* — Brian W Jennison
*Assistant Examiner* — Abigail H Rhue
(74) *Attorney, Agent, or Firm* — Dority & Manning, P.A.

(57) ABSTRACT

An oven appliance is provided. In one aspect, the oven appliance includes a cabinet with a cooking chamber for receipt of food for cooking. The oven appliance further includes multiple fans disposed within a fan enclosure defined by a cover. A divider is positioned between the fans to separate the fan enclosure into a top region and a bottom region. A shroud defines a fan opening in which one of the fans is positioned and separates the top region into a suction region and an exhaust region. The fans generate an airflow pattern within the cooking chamber based on a selected convection cooking mode.

18 Claims, 12 Drawing Sheets

OVEN APPLIANCE EQUIPPED WITH MULTIPLE FANS FOR SELECTING CONVECTION AIR FLOW DIRECTION

FIELD OF THE INVENTION

The present subject matter relates generally to oven appliances with features for convection cooking.

BACKGROUND OF THE INVENTION

An oven appliance generally includes a cabinet defining a cooking chamber. The cooking chamber is configured for receipt of food items for cooking. The oven appliance also includes a heating element for generating heat energy for cooking. The heating element can be, e.g., an electric resistance element or a gas burner. Certain oven appliances also include features for forcing movement of heated air within the cooking chamber. Such oven appliances are generally referred to as convection ovens.

Convection ovens can include a fan for circulating heated air within the cooking chamber. In some conventional convection ovens, the fan moves heated air through a plurality of slots or louvers in a sidewall or a back wall of the oven's cabinet. The heated air exiting the slots in the sidewall or back wall generally flows in a horizontal direction through the chamber. Such a configuration may distribute heat energy more evenly to both atop rack and a lower rack disposed below the top rack compared to other configurations. However, variations within the flow of heated air exiting the slots, e.g., due to slot size, slot configuration, or fan speed, can lead to uneven cooking. Also, heated air flowing from a back to a front of a food item may cause the back of the food item to cook more quickly than the front of the food item. Similarly, heated air affecting edges of a food item may cause the edges to cook more quickly than a center of the food item.

In some other conventional convection ovens, the fan moves heated air through a plurality of slots or louvers in a top wall of the oven's cabinet. The heated air exiting the slots in the top wall generally flows in a vertical direction through the chamber. Such a configuration distributes heat energy evenly to food items cooking on the top rack within the cooking chamber. However, food items cooking on the lower rack disposed below the top rack generally do not receive the benefits of the flow of heated air because the top rack and items disposed thereon prevent or disrupt the flow of heated air from continuing to the lower rack. Thus, when cooking food items on both the top and lower racks, the benefits of such a convection oven may be limited to the food items disposed on the top rack. To summarize, conventional convection oven appliances may evenly cook food items in some placements but not others.

Accordingly, an oven appliance with features for improved convection cooking would be useful. In particular, an oven appliance with features for selectively moving heated air along a horizontal and/or a vertical direction would be useful.

BRIEF DESCRIPTION OF THE INVENTION

Aspects and advantages of the invention will be set forth in part in the following description, or may be obvious from the description, or may be learned through practice of the invention.

In one aspect, an oven appliance is provided. The oven appliance includes a cabinet having a top wall, a bottom wall, a back wall, and opposing sidewalls defining a chamber. The chamber is configured for receipt of food items for cooking. The top wall defines a first plurality of apertures in fluid communication with the chamber. The oven appliance further includes a heating element for providing heat to the chamber. In addition, the oven appliance includes a cover mounted to the back wall and defining a second plurality of apertures and a third plurality of apertures, the cover and the back wall defining a fan enclosure, the second plurality of apertures and the third plurality of apertures providing fluid communication between the chamber and the fan enclosure. Further, the oven appliance includes a duct providing fluid communication between the fan enclosure and the first plurality of apertures defined by the top wall. The oven appliance also includes an axial fan positioned in the fan enclosure and operable to move air out of either the first plurality of apertures or the second plurality of apertures based at least in part on a selected cooking mode. Moreover, the oven appliance includes a radial fan positioned in the fan enclosure and operable to move air out of the third plurality of apertures based at least in part on the selected cooking mode.

In another aspect, an oven appliance is provided. The oven appliance defines a vertical direction, a lateral direction, and a transverse direction mutually perpendicular to one another. The oven appliance includes a cabinet having a top wall, a bottom wall, a back wall, and opposing sidewalls defining a chamber. The chamber is configured for receipt of food items for cooking. The top wall defines a first plurality of apertures in fluid communication with the chamber. In addition, the oven appliance includes a heating element for providing heat to the chamber. The oven appliance also includes a cover mounted to the back wall and defining a second plurality of apertures and a third plurality of apertures, the cover and the back wall defining a fan enclosure, the second plurality of apertures and the third plurality of apertures providing fluid communication between the chamber and the fan enclosure. Further, the oven appliance includes a duct providing fluid communication between the fan enclosure and the first plurality of apertures defined by the top wall. The oven appliance also includes a first fan and a second fan. In addition, the oven appliance includes a divider positioned between the first fan and the second fan along the vertical direction, the divider separating the fan enclosure into a top region in which the first fan is positioned and a bottom region in which the second fan is positioned, the top region being in fluid communication with the first plurality of apertures and the second plurality of apertures and the bottom region being in fluid communication with the third plurality of apertures.

In yet another aspect, a method of operating an oven appliance is provided. The method includes receiving, by a controller of the oven appliance, an input indicating a selected convection cooking mode. The method also includes causing, by the controller, at least one of a first fan and a second fan to move air within a cooking cavity defined by a cabinet of the oven appliance based at least in part on the selected convection cooking mode. Further, when the first fan is caused to move air within the cooking chamber, the first fan moves air out of either a first plurality of apertures defined by a top wall of the cabinet or a second plurality of apertures defined by a cover based at least in part on the selected convection cooking mode. The cover defines a fan enclosure in which the first fan is positioned. In addition, when the second fan is caused to move air within the cooking chamber, the second fan moves air out of the third plurality of apertures based at least in part on the selected convection cooking mode, the second fan being positioned within the fan enclosure.

These and other features, aspects and advantages of the present invention will become better understood with reference to the following description and appended claims. The accompanying drawings, which are incorporated in and constitute a part of this specification, illustrate exemplary embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
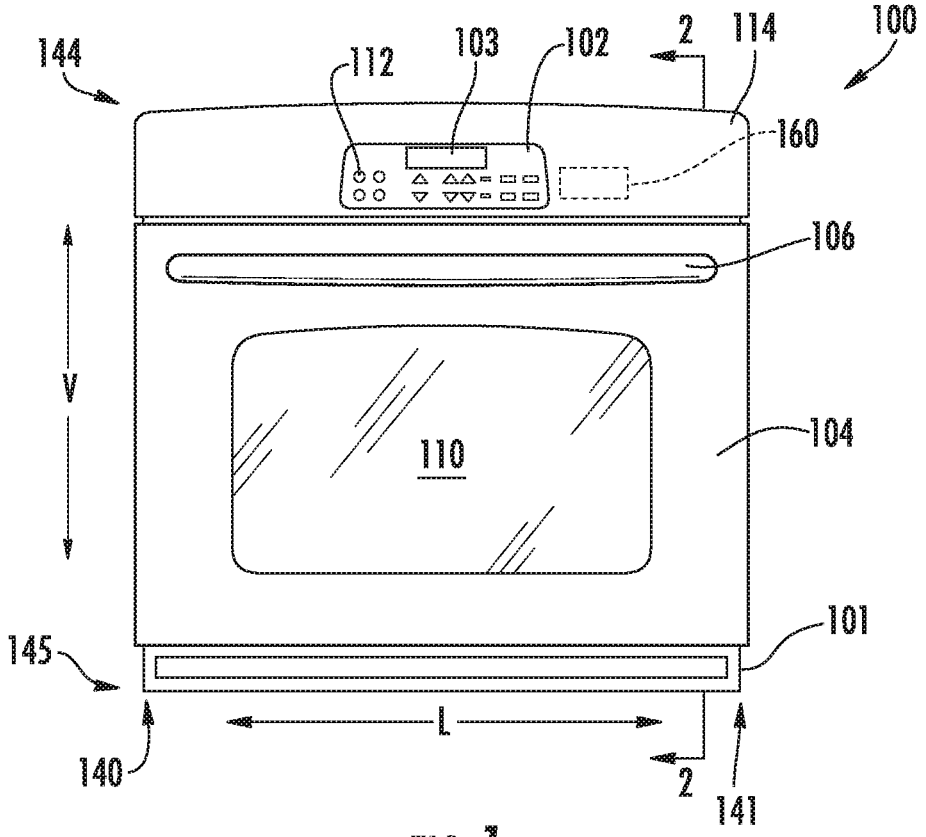
FIG. 1 provides a front view of an oven appliance according to an exemplary embodiment of the present subject matter.

Reference now will be made in detail to exemplary embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
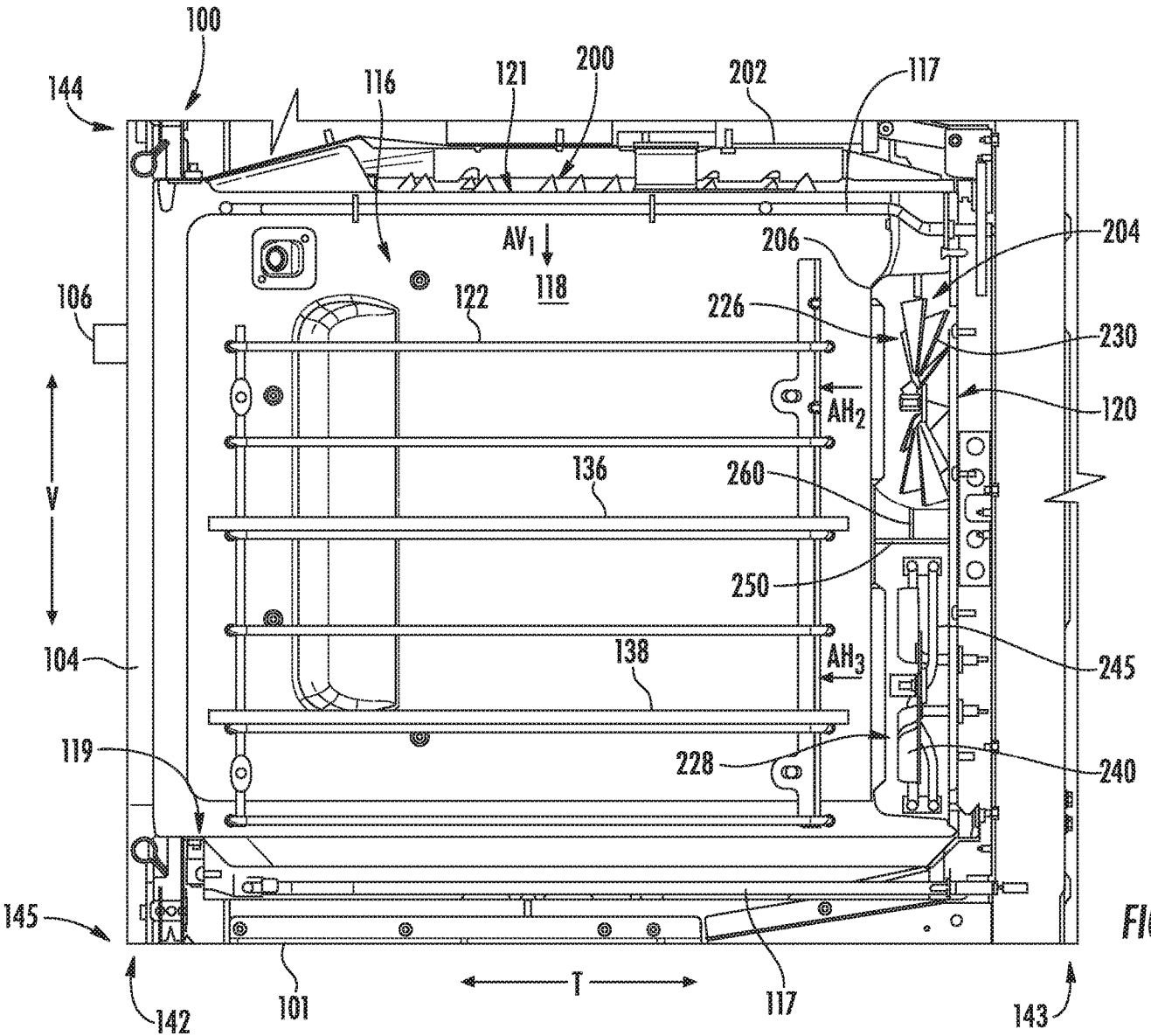
FIG. 2 provides a cross-sectional view of the oven appliance taken along the 2-2 axis of FIG. 1.
Figure 3:
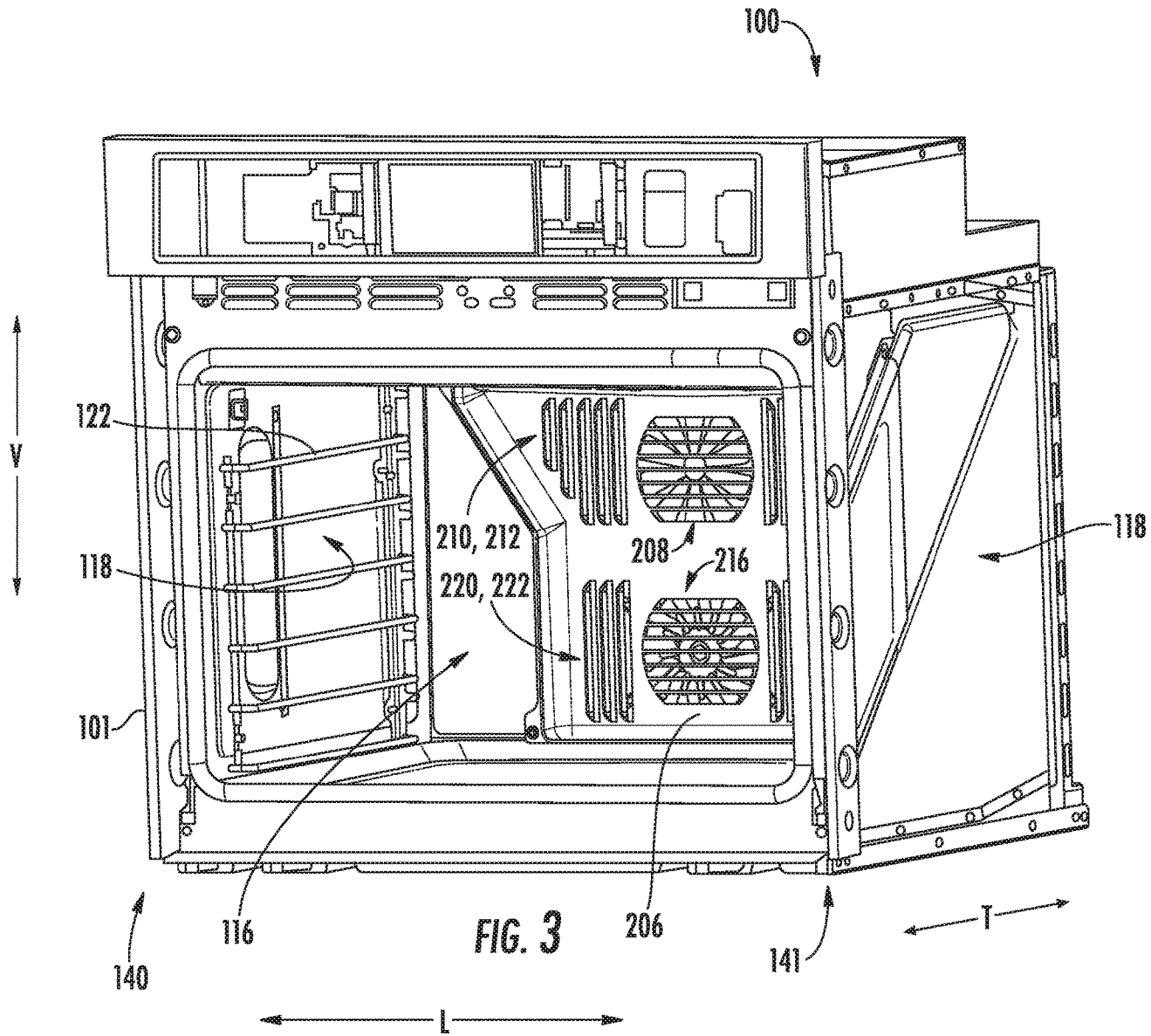
FIG. 3 provides a perspective view of the oven appliance of FIG. 1 with a door and other components of the oven appliance removed for illustrative purposes.

FIGS. 1 and 2 provide various views of an oven appliance 100 according to one example embodiment of the present disclosure. Particularly, FIG. 1 provides a front view of oven appliance 100 and FIG. 2 provides a cross-sectional view of oven appliance 100 taken along the 2-2 axis shown in FIG. 1. For reference, oven appliance 100 defines a vertical direction V, a lateral direction L, and a transverse direction T. The vertical direction V, lateral direction L, and transverse direction T are mutually perpendicular to one another such that they define an orthogonal direction system. Moreover, as used herein, a horizontal direction is a direction along the lateral direction L and/or the transverse direction T. That is, the horizontal direction is orthogonal to the vertical direction V.

Oven appliance 100 has a housing or cabinet 101 that defines a cooking chamber 116. Cooking chamber 116 is configured for receipt of food items for cooking. Cabinet 101 extends between a first side 140 (e.g., a left side) and a second side 141 (e.g., a right side) along the lateral direction L. Cabinet 101 also extends between a front 142 and a back 143 along the transverse direction T. Cabinet 101 further extends between a top 144 and a bottom 145 along the vertical direction V.

Cabinet 101 has interior walls including opposing sidewalls 118 (only one shown in FIG. 2), a bottom wall 119, a back wall 120, and a top wall 121 that define cooking chamber 116. Bottom wall 119 and top wall 121 are spaced apart along the vertical direction V and sidewalls 118 extend along the vertical direction V between top wall 121 and bottom wall 119. Back wall 120 extends between sidewalls 118 along the lateral direction L and also extends between top wall 121 and bottom wall 119 along the vertical direction V. Sidewalls 118 include supports 122 for supporting oven racks that may be selectively positioned within cooking chamber 116. For the depicted embodiment, oven appliance 100 includes a top rack 136 and a bottom rack 138. Top rack 136 is positioned above bottom rack 138 along the vertical direction V. It will be appreciated that oven appliance 100 can include more or less than two (2) racks.

Oven appliance 100 includes a door 104 that is movable between an open position and a closed position (shown in FIGS. 1 and 2) for selective access to cooking chamber 116. Door 104 has a handle 106 that facilitates opening and closing of door 104. A user of oven appliance 100 can place a variety of different items to be cooked in cooking chamber 116 onto the racks, including top rack 136 and/or bottom rack 138.

Oven appliance 100 includes one or more heating elements, e.g., for providing heat to the food items placed in cooking cavity 116. For the depicted embodiment of FIG. 2, oven appliance 100 includes heating elements 117 positioned at the top and the bottom of chamber 116 to provide heat for cooking and/or cleaning. Such heating element(s) can be e.g., gas, electric, microwave, or a combination thereof. Other heating elements (not shown) could be located at other locations as well. A window 110 on door 104 allows for viewing of the contents within cooking chamber 116, such as food items.

Oven appliance 100 also includes a user interface 102 positioned on a top panel 114. User interface 102 has a display 103 and a variety of controls 112. User interface 102 allows a user to select various options for the operation of oven appliance 100, including selection of a temperature, a time, and/or various cooking and cleaning cycles. Operation of oven appliance 100 can be regulated by a controller 160 that is communicatively coupled with user interface panel 102, heating element(s) 117 (FIG. 2), and other components of oven appliance 100.

For example, in response to user manipulation of the user interface panel 102, controller 160 can activate or cause heating element(s) 117 (FIG. 2) to provide heat. Further, as will be explained herein, controller 160 can receive an input indicating a selected convection cooking mode (e.g., selected by a user or automatically based on the food items present in the cooking chamber 116), and can cause one or more fans of oven appliance 100 to generate or produce a distinct airflow pattern within cooking chamber 116, e.g., to enhance the cooking operation.

Controller 160 can include one or more memory devices and one or more processing devices. The one or more memory devices can include a non-transitory computer readable media, FLASH, RAM, ROM, or electrically erasable, programmable read only memory (EEPROM). The one or more processing devices can include one or more microprocessors, CPUs or the like, such as general or special purpose microprocessors operable to execute programming instructions or micro-control code associated with operation of oven appliance 100. In some embodiments, the processor executes programming instructions stored in memory. For example, the instructions may be software or any set of instructions that when executed by the processing device, cause the processing device to perform operations. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 160 may be positioned in a variety of locations throughout oven appliance 100. For instance, controller 160 can be located within or proximate the user interface panel 140. In other embodiments, controller 160 may be positioned at any suitable location within oven appliance 100. Input/output ("I/O") signals may be routed between controller 160 and various operational components of oven appliance 100 as noted above. For example, user interface 102 can be in communication with controller 160 via one or more signal lines or shared communication busses. In some embodiments, input/output ("I/O") signals are routed between the controller 160 and various operational components of oven appliance 100 such as heating element(s) 117, controls 112, display 103, sensor(s), alarms, and/or other components as may be provided. Moreover, in some embodiments, user interface panel 102 may represent a general purpose I/O ("GPIO") device or functional block.

Although shown with touch type controls 112, it should be understood that controls 112 and the configuration of oven appliance 100 shown in FIG. 1 is provided by way of example only. More specifically, user interface 102 may include various input components, such as one or more of a variety of electrical, mechanical or electro-mechanical input devices including rotary dials, push buttons, and touch pads. The user interface 102 may include other display components, such as a digital or analog display device designed to provide operational feedback to a user. Also, oven appliance 100 is shown as a wall oven but the inventive aspects of the present subject matter can also be used with other appliances, such as stand-alone ovens, ovens with a stove-top, and other configurations as well.

Oven appliance 100 is equipped with features for selectively generating a forced flow of heated air within cooking chamber 116 (e.g., using one or more fans as discussed in greater detail below). Thus, oven appliance 100 is generally referred to as a convection oven. Such a flow of heated air can decrease the required cooking temperature for food items, decrease the amount of time needed to cook food items, and/or assist in cooking food items more evenly, among other benefits and advantages. Features of oven appliance 100 for selectively generating a forced flow of heated air within cooking chamber 116 are provided in more detail below.

As depicted in FIG. 2, top wall 121 of cabinet 101 defines a first plurality of apertures 200 or louvers in fluid communication with cooking chamber 116. Air can flow into or out of the first plurality of apertures 200 based on the selected convection cooking mode. When air flows out of the first plurality of apertures 200 and into cooking chamber 116, the air exits the first plurality of apertures 200 generally along the vertical direction V, as denoted by the arrow $Av_1$. When air flows from cooking chamber 116 into the first plurality of apertures 200, the air enters a duct 202 that provides fluid communication between the first plurality of apertures 200 and a fan enclosure 204 defined by a cover 206.

Figure 4:
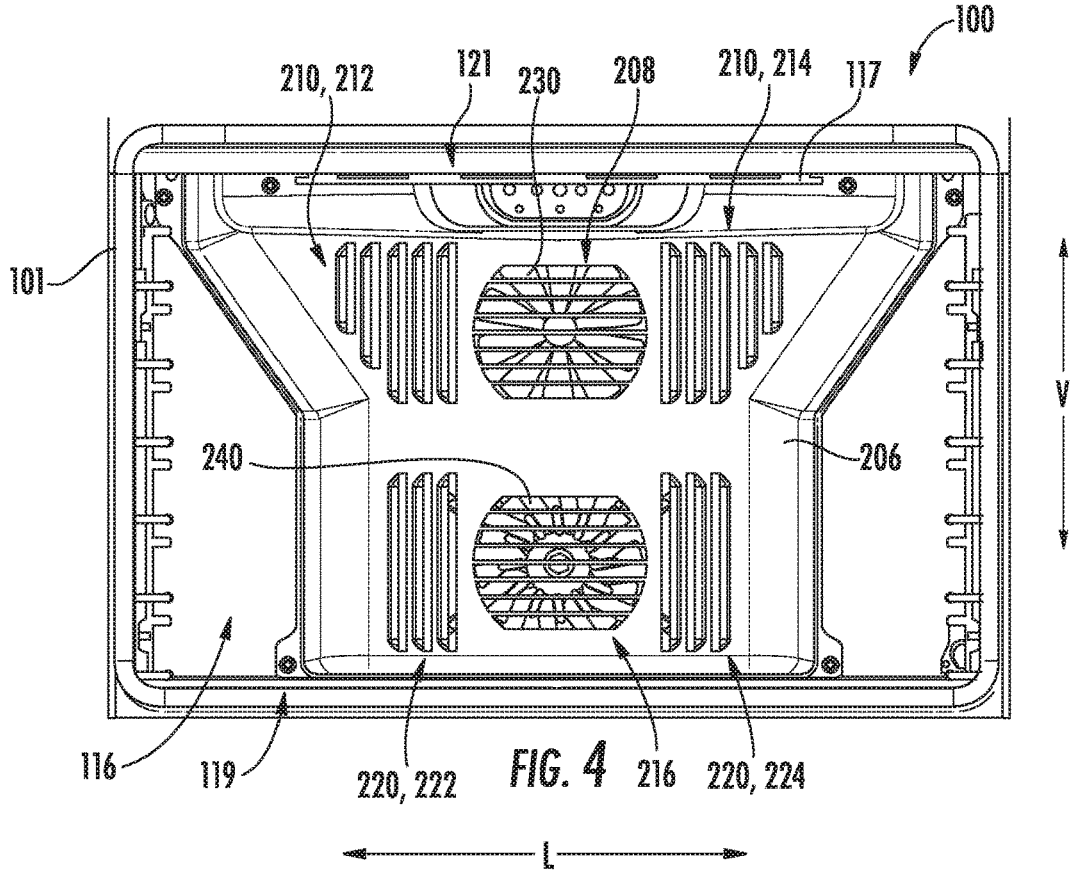
FIG. 4 provides a front view of the oven appliance of FIG. 1 with the door removed for illustrative purposes.
Figure 5:
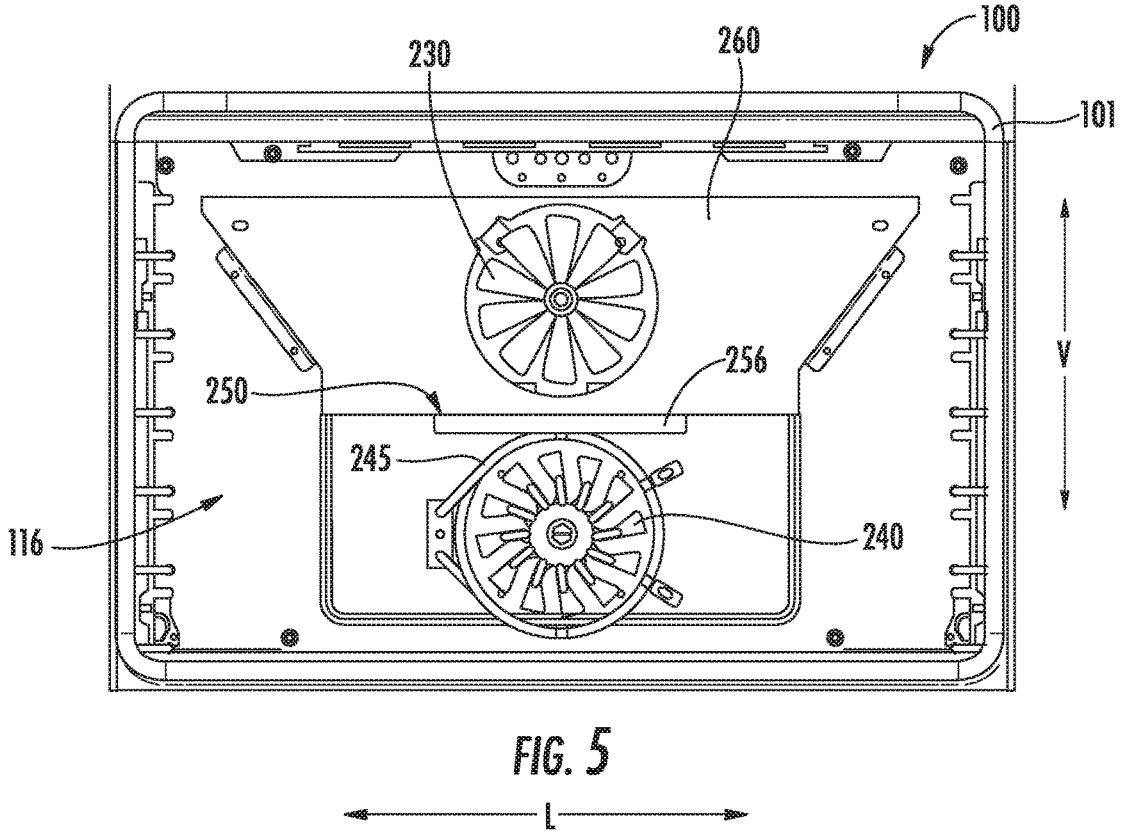
FIG. 5 provides a front view of the oven appliance of FIG. 1 with the door and a cover removed for illustrative purposes.

With reference now to FIGS. 2, 3, 4, and 5, FIG. 3 provides a front perspective view of oven appliance 100 with door 104 and other components removed for illustrative purposes. FIG. 4 provides a front view of the oven appliance 100 with door 104 removed for illustrative purposes. FIG. 5 provides a front view of oven appliance 100 with door 104 and cover 206 removed for illustrative purposes. As depicted, cover 206 is mounted to back wall 120 of cabinet 101. Cover 206 and back wall 120 define fan enclosure 204, which generally can be described as the area or space between cover 206 and back wall 120. As noted above, duct 202 provides fluid communication between fan enclosure 204 and the first plurality of apertures 200 defined by top wall 121 of cabinet 101.

Cover 206 also defines a plurality of apertures that provide fluid communication between fan enclosure 204 and cooking chamber 116. Particularly, cover 206 defines a plurality of intake/exhaust apertures 208 or louvers and a second plurality of apertures 210 or louvers. The plurality of intake/exhaust apertures 208 and the second plurality of apertures 210 are in fluid communication with cooking chamber 116. The second plurality of apertures 210 include a first set of apertures 212 and a second set of apertures 214 located on opposite sides of the plurality of intake/exhaust apertures 208. Each of the second plurality of apertures 210 are oriented longitudinally or lengthwise along the vertical direction V and each of the plurality of intake/exhaust apertures 208 are oriented longitudinally or lengthwise along the lateral direction L. When air flows out of the second plurality of apertures 210 and the plurality of intake/exhaust apertures 208 and into cooking chamber 116, the air exits the second plurality of apertures 210 and the plurality of intake/exhaust apertures 208 generally horizontally, as denoted by the arrow $A_{H2}$ in FIG. 2.

Below the plurality of intake/exhaust apertures 208 and the second plurality of apertures 210 along the vertical direction V, cover 206 defines a plurality of intake apertures 216 and a third plurality of apertures 220 or louvers. The plurality of intake apertures 216 and the third plurality of apertures 220 are in fluid communication with cooking chamber 116. The third plurality of apertures 220 include a first set of apertures 222 and a second set of apertures 224 located on opposite sides of the plurality of intake apertures 216 along the lateral direction L. Each of the third plurality of apertures 220 are oriented longitudinally or lengthwise along the vertical direction V and each of the plurality of intake apertures 216 are oriented longitudinally or lengthwise along the lateral direction L. The intake apertures 216 are aligned with the intake/exhaust apertures 208 along the lateral direction L. When air flows out of the third plurality of apertures 220 and the plurality of intake apertures 216 and into cooking chamber 116, the air exits the third plurality of apertures 220 and the plurality of intake apertures 216 generally horizontally, as denoted by the arrow $A_{H3}$ in FIG. 2.

Oven appliance 100 includes multiple fans. For this embodiment, oven appliance 100 includes a first fan and a second fan. The first fan is an axial fan 230 and the second fan is a radial fan 240. Axial fan 230 is positioned in the fan enclosure 204 and is operable to move air out of either the first plurality of apertures 200 or the second plurality of apertures 210 based at least in part on a selected cooking mode. In some selected cooking modes, axial fan 230 can remain off or not active such that axial fan 230 moves air out of neither the first plurality of apertures 200 nor the second plurality of apertures 210. That is, in some selected cooking modes, axial fan 230 does not rotate about its axis of rotation. Radial fan 240 is positioned in the fan enclosure 204 and is operable to move air out of the third plurality of apertures 220 based at least in part on the selected cooking mode. In some selected cooking modes, radial fan 240 can remain off or not active such that radial fan 240 does not move air out of the third plurality of apertures 220. That is, in some selected cooking modes, radial fan 240 does not rotate about its axis of rotation.

For this embodiment, axial fan 230 is positioned above radial fan 240 along the vertical direction V in this example embodiment. Moreover, cover 206 defines the plurality of intake/exhaust apertures 208 such that they are aligned with axial fan 230 along the lateral direction L and the vertical direction V. In addition, cover 206 defines the plurality of intake apertures 216 such that they are aligned with radial fan 240 along the lateral direction L and the vertical direction V.

Figure 6:
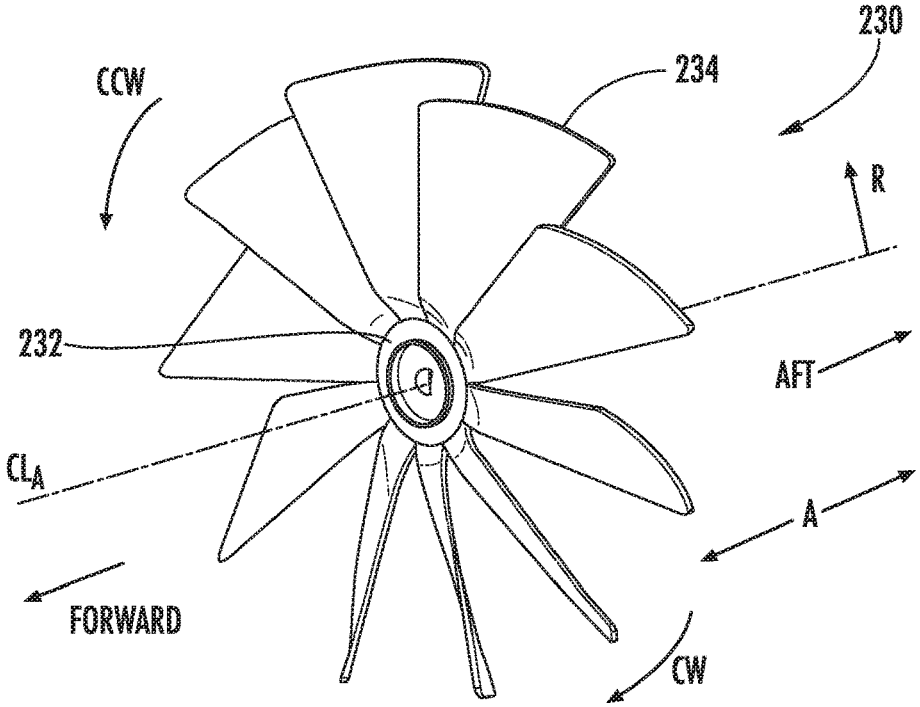
FIG. 6 provides a perspective view of an axial fan of the oven appliance of FIG. 1.
Figure 7:
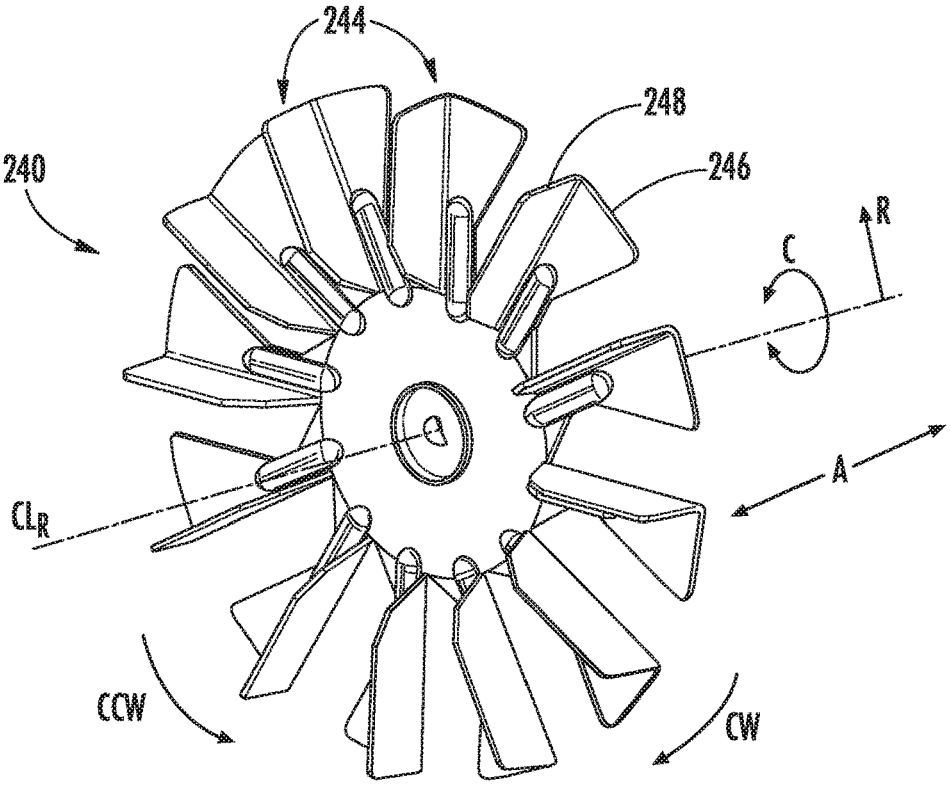
FIG. 7 provides a perspective view of a radial fan of the oven appliance of FIG. 1.

FIGS. 6 and 7 provide perspective views of axial fan 230 and radial fan 240, respectively. As shown in FIG. 6, axial fan 230 defines an axial direction A, a centerline $CL_A$ extending along the axial direction A, and a radial direction R. Axial fan 230 includes a hub 232 and a plurality of blades 234 that extend radially outward from hub 232. The plurality of blades 234 are shaped such that axial fan 230 can move air axially forward or axially aft of axial fan 230 depending on its rotation direction. For instance, axial fan 230 is rotatable about an axis of rotation in a first direction (e.g., counterclockwise CCW) and a second direction (e.g., clockwise CW), the second direction being opposite to the first direction. For the depicted axial fan 230 of FIG. 6, the plurality of blades 234 are shaped such that axial fan 230 moves air axially aft when rotated in the first direction (e.g., CCW) and such that axial fan 230 moves air axially forward when rotated in the second direction (e.g., CW).

As shown in FIG. 7, radial fan 240 defines an axial direction A, a centerline $CL_R$ extending along the axial direction A, a radial direction R, and a circumferential direction C extending three hundred sixty degrees (360°) around the centerline $CL_R$. Radial fan 240 includes a hub 242 and a plurality of blades 244 that extend radially outward from hub 242. The plurality of blades 244 of radial fan 240 each include a first blade portion 246 and a second blade portion 248. The first blade portion 246 of each blade 244 extends generally in a plane orthogonal to the axial direction A and the second blade portion 248 of each blade extends generally in a plane orthogonal to the circumferential direction C. For the depicted embodiment of FIG. 7, radial fan 240 is configured to rotate in a CW as viewed from the perspective of FIG. 7. In this manner, radial fan 240 is operable to move or pull air axially and then move the air radially outward (i.e., away from hub 242 along the radial direction R).

With reference now to FIGS. 2, 9, 11, and 12, the fan enclosure 204 is separated or demarcated into regions by a divider 250. As depicted, divider 250 is positioned between the axial fan 230 and the radial fan 240 along the vertical direction V. Divider 250 separates the fan enclosure 204 into a top or first region 226 and a bottom or second region 228. Thus, the airflows generated by axial fan 230 and radial fan 240 can be kept substantially fluidly isolated from one another. Divider 250 has a horizontal plate 252 that extends generally in a plane orthogonal to the vertical direction V. Moreover, horizontal plate 252 extends between a front and a back along the transverse direction T and between a first side (e.g., the left side) and a right side (e.g., the right side) along the lateral direction L. Horizontal plate 252 is sized and positioned between axial fan 230 and radial fan 240 so that airflows generated by axial fan 230 and radial fan 240 can be kept substantially fluidly isolated from one another. Notably, the second plurality of apertures 210 are defined by cover 206 above divider 250 along the vertical direction V and the third plurality of apertures 220 are defined by cover 206 below divider 250 along the vertical direction V.

Figure 10:
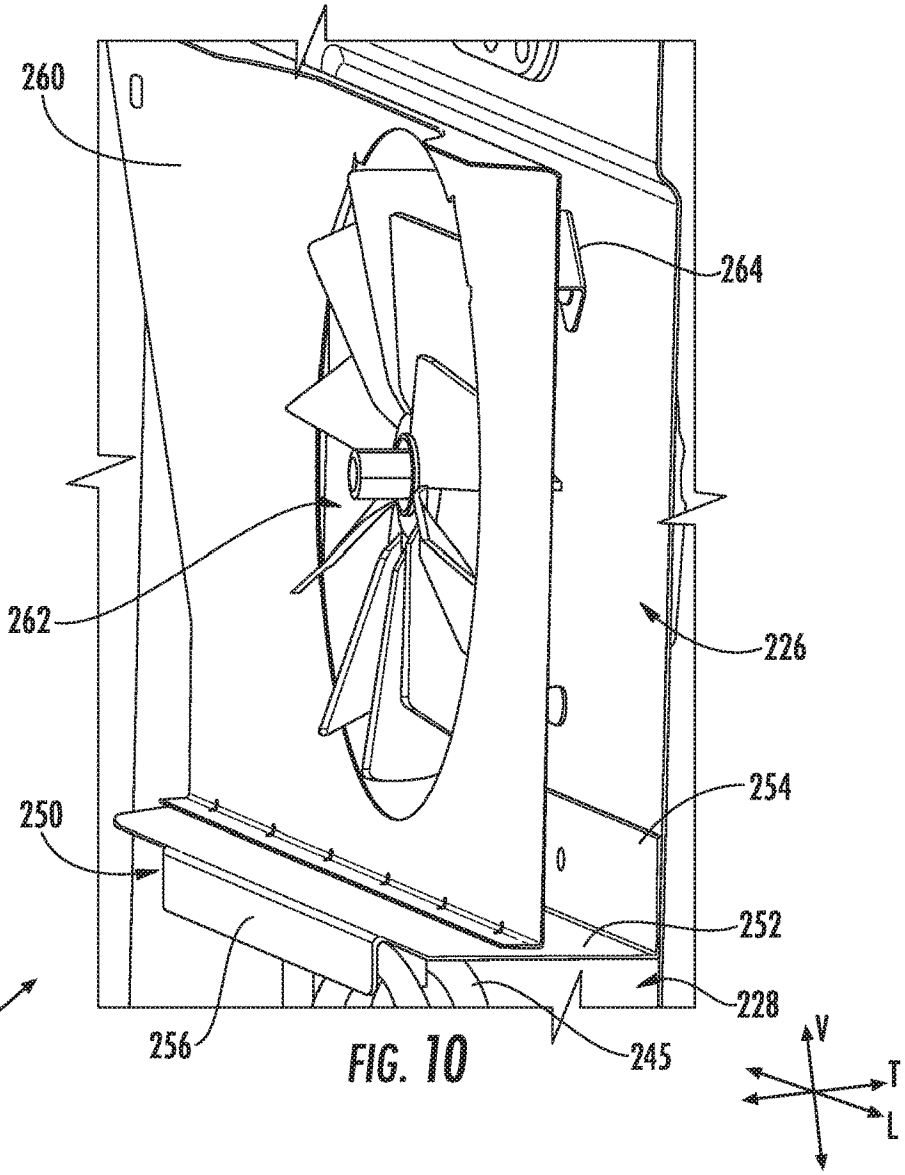
FIG. 10 provides a perspective view of the axial fan of FIG. 6 positioned within a fan opening defined by the shroud of FIG. 8.
Figure 8:
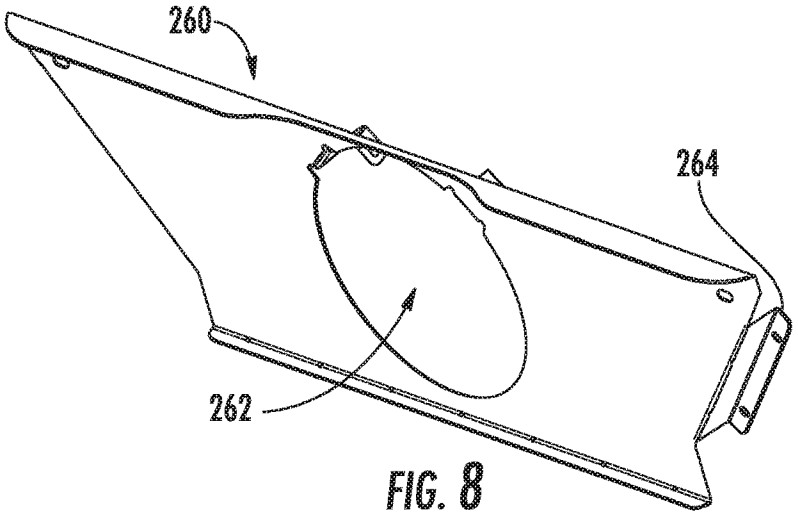
FIG. 8 provides a perspective view of a shroud of the oven appliance of FIG. 1.
Figure 9:
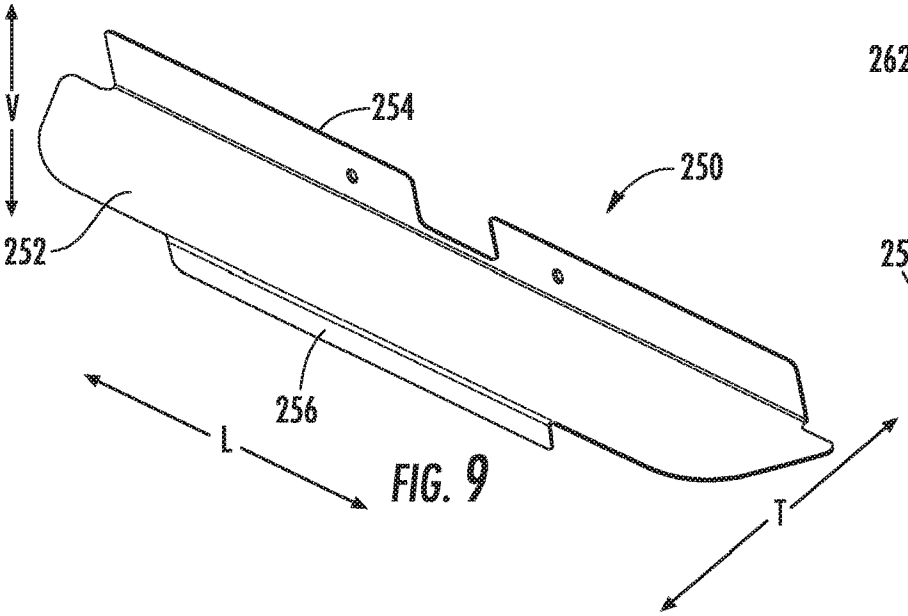
FIG. 9 provides a perspective view of a divider of the oven appliance of FIG. 1.
Figure 12:
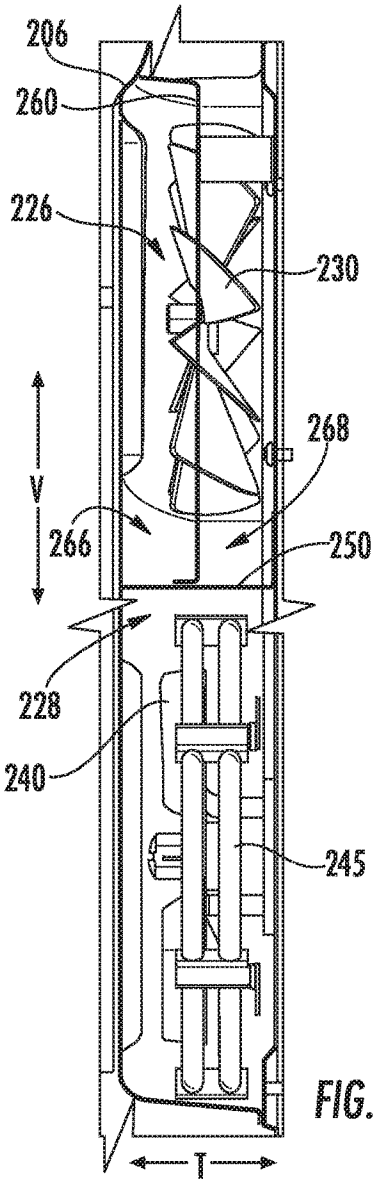
FIG. 12 provides a side view of the axial fan of FIG. 6 and the radial fan of FIG. 7 disposed within a fan enclosure defined by a cover and a backwall of the oven appliance of FIG. 1.
Figure 11:
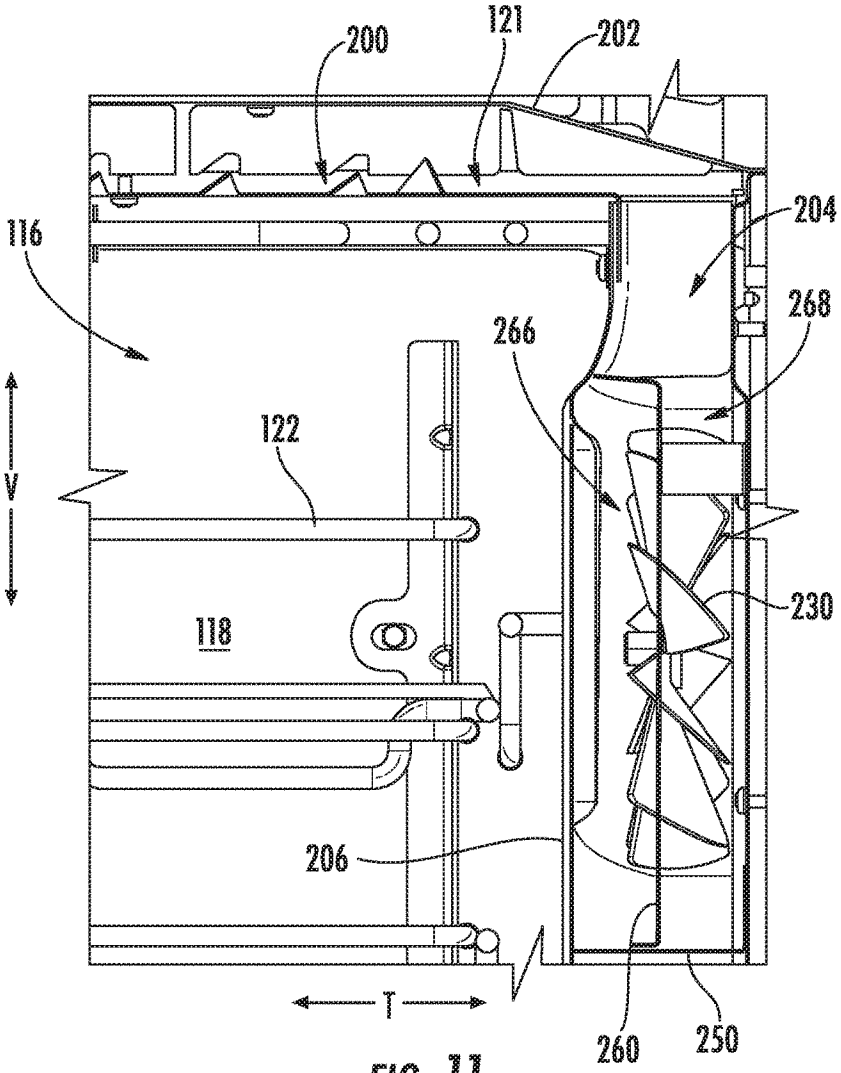
FIG. 11 provides a close up side view of the axial fan of FIG. 6 disposed within a fan enclosure defined by a cover and a backwall of the oven appliance of FIG. 1.

Divider 250 also includes a mounting flange 254 that extends from the back of horizontal plate 252. Mounting flange 254 extends upward along the vertical direction V from horizontal plate 252 in a plane orthogonal to the transverse direction T. Fasteners can be used to secure mounting flange 254 to back wall 120. In this manner, divider 250 is mounted to back wall 120. In some embodiments, divider 250 includes a forward flange 256 that extends downward along the vertical direction V from horizontal plate 252 in a plane orthogonal to the transverse direction T. Forward flange 256 can provide a stiffening structure for divider 250. Forward flange 256 can be completely detached from other components or can be mounted to one or more structures. For instance, forward flange 256 can be attached or connected to cover 206 or to another component, such as an optional heating element 245 associated with and surrounding radial fan 240, e.g., as shown in FIG. 10. In some embodiments, although not shown, a heating element can optionally be associated with and surround axial fan 230.

With reference now to FIGS. 2, 8, 9, 11, and 12, oven appliance 100 also includes a shroud 260. Shroud 260 defines a fan opening 262 in which axial fan 230 is positioned, e.g., as shown best in FIG. 10. Particularly, shroud 260 is aligned with axial fan 230 along the transverse direction T. Fan opening 262 of shroud 260 is sized such that axial fan 230 is rotatable about its axis of rotation within fan opening 262. Shroud 260 can be mounted to horizontal plate 252 of divider 250 at its bottom end and to rear wall 120 via a pair of side tabs 264 (only one shown in FIGS. 8 and 10). Alternatively, shroud 260 can be seated on horizontal plate 252 of divider, but not attached thereto. In yet other embodiments, shroud 260 and horizontal plate 252 need not be in contact; rather, a small gap can be defined between them. Notably, shroud 260 separates the top or first region 226 of fan enclosure 204 into a suction region 266 and an exhaust region 268, e.g., as shown best in FIG. 11. In some selected convection cooking modes, the suction region 266 of first region 226 is forward of axial fan 230 and exhaust region 268 is rearward of axial fan 230 along the transverse direction T. In yet other selected cooking modes, the suction region 266 of first region 226 is rearward of axial fan 230 and exhaust region 268 is forward of axial fan 230 along the transverse direction T. Generally, the air within the suction region 266 has a lower pressure than the exhaust region 268. Shroud 260 maintains the pressure differential between the two regions, e.g., by preventing air from the high pressure side or exhaust region 268 from leaking into the low pressure side or suction region 266.

For this embodiment, with general reference to FIGS. 1 through 12, oven appliance 100 is operable in at least five selectable cooking modes, including a first cooking mode, a second cooking mode, a third cooking mode, a fourth cooking mode, and a fifth cooking mode. As will be explained further below, for each of the selectable cooking modes, axial fan 230 and radial fan 240 are configured to produce a distinct airflow pattern within cooking chamber 116.

A user can select one of the convection cooking modes by providing a user input, e.g., to user interface 102 (FIG. 1). In other embodiments, based at least in part on the food item disposed in the cooking cavity 116 or based on some other criteria, controller 160 is operable to automatically select the convection cooking mode. In some embodiments, controller 160 (FIG. 1) can change or switch between modes during a cooking operation. In some embodiments, for example, controller 160 is configured to receive an input indicating the selected cooking mode. As noted, this can be based on a user selection or an automatic selection by controller 160.

Controller 160 is then configured to set an operation state of axial fan 230 and an operation state of radial fan 240 based at least in part on the selected cooking mode. In setting the operation state of axial fan 230, controller 160 can toggle axial fan 230 between on/off states. For instance, controller 160 can toggle axial fan 230 to an on state if axial fan 230 is off or controller 160 can toggle axial fan 230 to an off state if axial fan 230 is on. Moreover, controller 160 can set a rotation direction of axial fan 230 about its axis of rotation. As noted above, axial fan 230 can be rotated in a first direction or a second direction about its axis of rotation. The rotation direction of axial fan 230 is set by controller 160 to generate the desired circulation of airflow through cooking chamber 116. In setting the operation state of radial fan 240, controller 160 can toggle radial fan 240 between on/off states. That is, controller 160 can turn on or turn off radial fan 240 based on the selected cooking mode.

After setting the operation states of axial fan 230 and radial fan 240, controller 160 is configured to cause axial fan 230 to move air out of either the first plurality of apertures 200 or the second plurality of apertures 210 based at least in part on the set operation state of axial fan 230. Controller 160 is also configured to cause radial fan 240 to move air out of the third plurality of apertures 220 based at least in part on the set operation state of radial fan 240.

Figure 14:
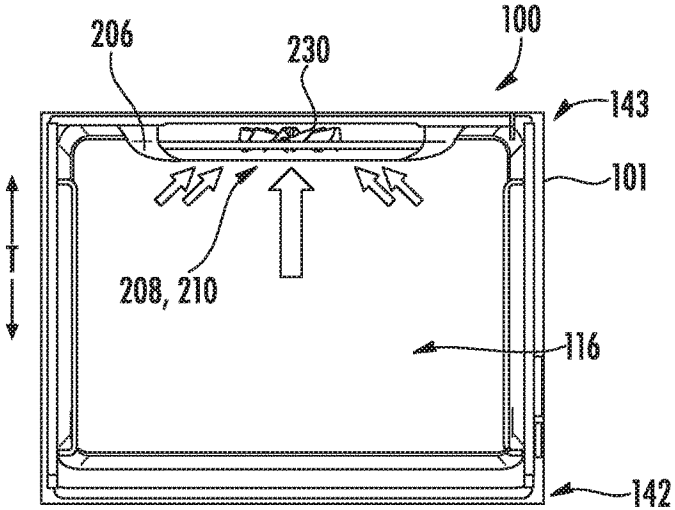
FIGS. 13, 14, and 15 depict a first airflow pattern associated with a first selected cooking mode.
Figure 15:
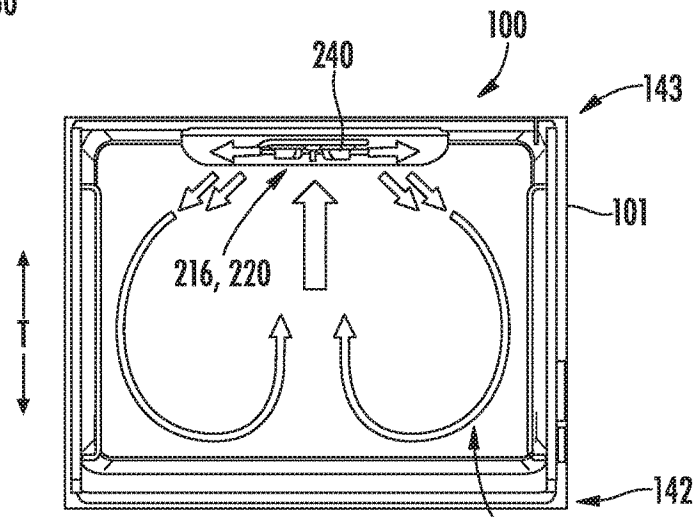
Figure 13:
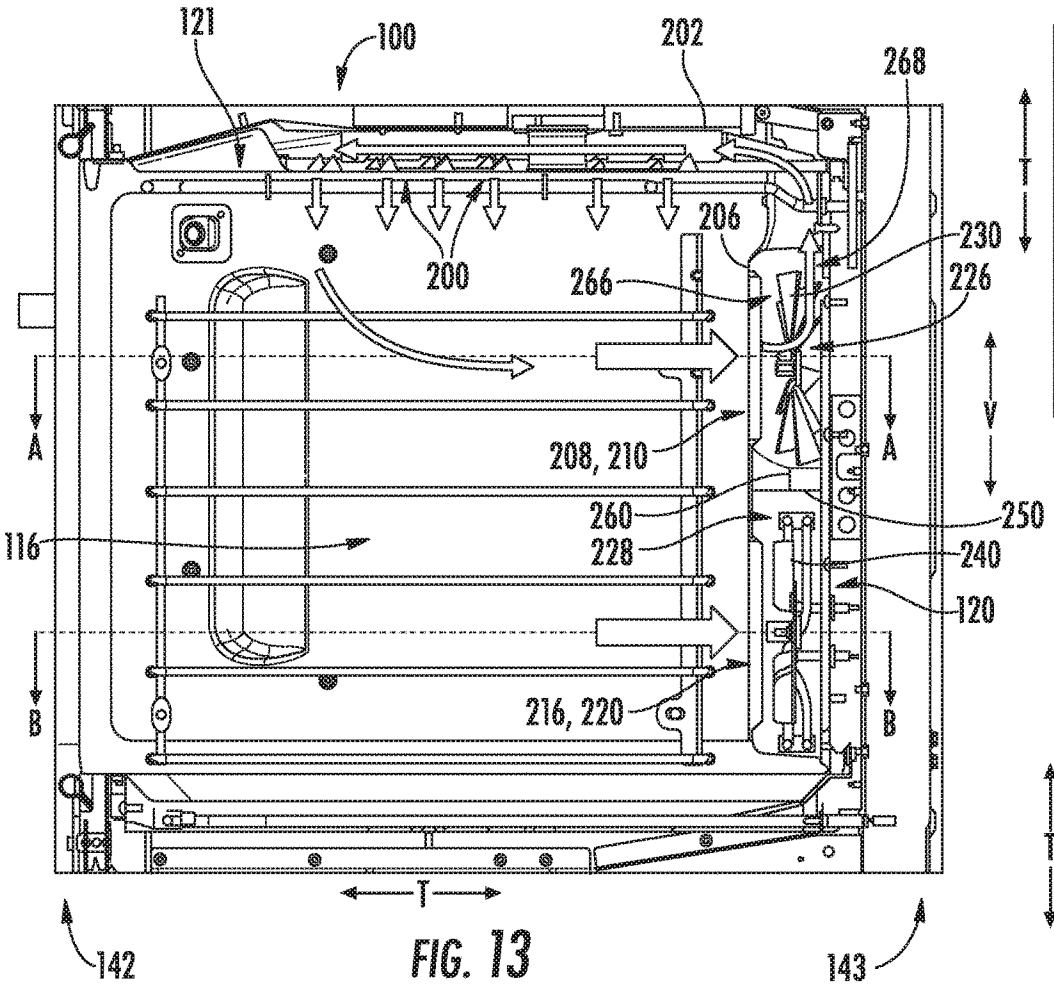

FIGS. 13, 14, and 15 depict a first airflow pattern generated by axial fan 230 and radial fan 240 within cooking chamber 116 when the first cooking mode is selected, e.g., by a user or automatically by controller 160 (FIG. 1). FIG. 13 provides a schematic cross-sectional view of oven appliance 100 and depicts the first airflow pattern. FIG. 14 provides a top cross-sectional view of oven appliance 100 taken along the A-A axis of FIG. 13. FIG. 15 provides a top cross-sectional view of oven appliance 100 taken along the B-B axis of FIG. 13.

In the first cooking mode, controller 160 (FIG. 1) sets the operation state of axial fan 230 and radial fan 240 such that axial fan 230 is in an on state and rotated in the first direction (e.g., CCW) and radial fan 240 is in an on state. As depicted, when axial fan 230 rotates about its axis of rotation in the first direction, axial fan 230 moves air out of the first plurality of apertures 200 defined by the top wall 121. More particularly, when axial fan 230 rotates about the axis of rotation in the first direction, axial fan 230 moves air from cooking chamber 116 into the intake/exhaust apertures 208 and the second plurality of apertures 210 as shown in FIGS. 13 and 14, and ultimately, the air flows out of the first plurality of apertures 200 defined by top wall 121 and back into cooking chamber 116 as shown in FIG. 13.

In the first cooking mode, the low pressure suction region 266 of top or first region 226 is forward of axial fan 230 along the transverse direction T and the high pressure exhaust region 268 is aft or back of axial fan 230 along the transverse direction T. That is, due to the blade configuration and rotation direction of axial fan 230 in the first direction, air is pulled from cooking chamber 116 into suction region 266 of first region 226 and passed to the exhaust region 268 through fan opening 262 (FIGS. 8 and 10) of shroud 260. As noted above, shroud 260 creates and maintains the pressure differential between the suction region 266 and the exhaust region 268. The air at relatively high pressure within the exhaust region 268 flows downstream to a lower pressure region. In this example, the lower pressure region is through duct 202 and out of the first plurality of apertures 200 into cooking chamber 116. Notably, when air exits out of the first plurality of apertures 200, the air exits substantially vertically, and thus, the air initially contacts the food items within cooking chamber 116 vertically.

As shown best in FIGS. 13 and 15, when radial fan 240 rotates about its axis of rotation, radial fan 240 moves air in through the plurality of intake apertures 216 and moves the air radially outward such that the air flows out through the first set of apertures 222 (FIG. 4) and the second set of apertures 224 (FIG. 4) of the third plurality of apertures 220 and back into cooking chamber 116. When air exits out of the third plurality of apertures 220, the air exits substantially horizontally, and thus, the air contacts the food items within cooking chamber 116 horizontally. Accordingly, in the first selected cooking mode, the airflow pattern includes an airflow circuit that initially contacts the food substantially vertically and an airflow circuit that initially contacts the food substantially horizontally.

Figure 17:
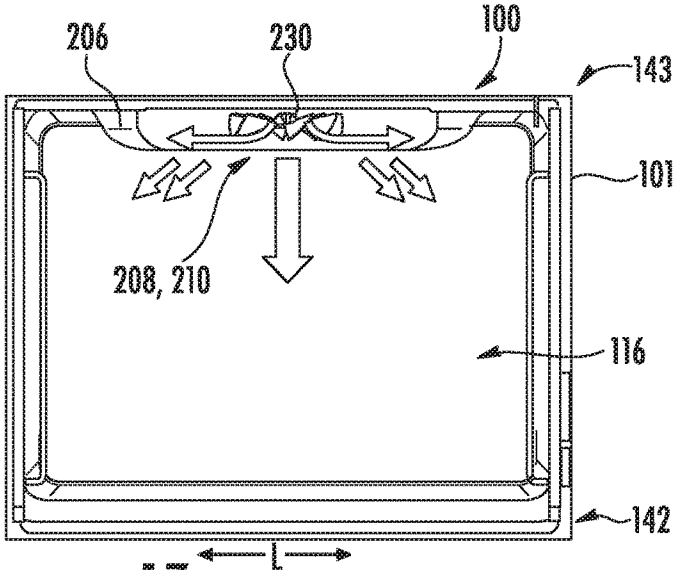
FIGS. 16, 17, and 18 depict a second airflow pattern associated with a second selected cooking mode.
Figure 18:
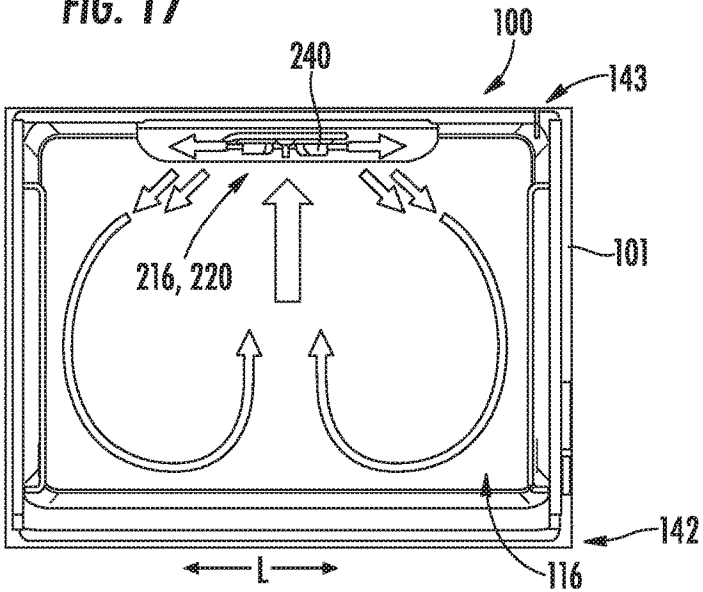
Figure 16:
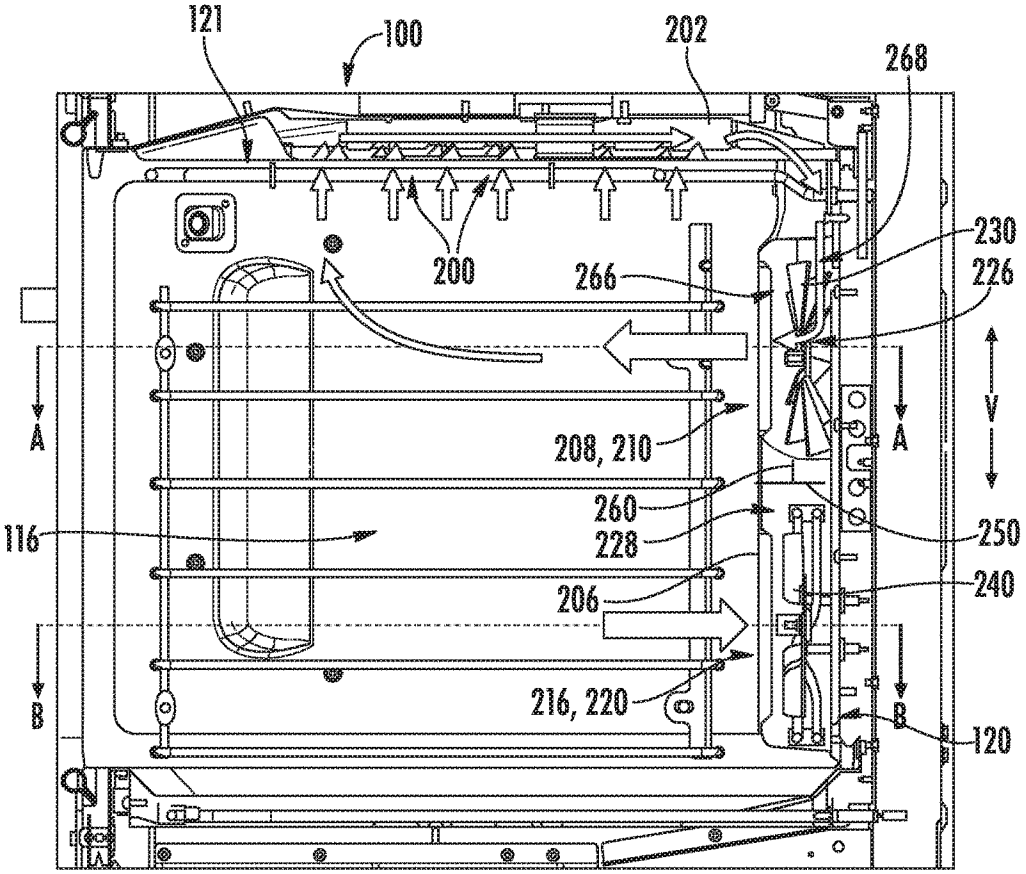

FIGS. 16, 17, and 18 depict a second airflow pattern generated by axial fan 230 and radial fan 240 within cooking chamber 116 when the second cooking mode is selected. FIG. 16 provides a schematic cross-sectional view of oven appliance 100 and depicts the second airflow pattern. FIG. 17 provides a top cross-sectional view of oven appliance 100 taken along the A-A axis of FIG. 16. FIG. 18 provides a top cross-sectional view of oven appliance 100 taken along the B-B axis of FIG. 16.

In the second cooking mode, controller 160 sets the operation state of axial fan 230 and radial fan 240 such that axial fan 230 is in an on state and rotated in the second direction (e.g., CW) and radial fan 240 is in an on state. As depicted, when axial fan 230 rotates about its axis of rotation in the second direction, axial fan 230 moves air out of the second plurality of apertures 210 defined by cover 206. More specifically, when axial fan 230 rotates about the axis of rotation in the second direction, axial fan 230 moves air from cooking chamber 116 into the first plurality of apertures 200 defined by top wall 121 as shown in FIG. 16, and out of the first set of apertures 212 and the second set of apertures 214 of the second plurality of apertures 210 and the plurality of intake/exhaust apertures 208 defined by cover 206 and back into cooking chamber 116 as shown in FIGS. 16 and 17.

In the second cooking mode, the low pressure suction region 266 of top or first region 226 is aft of axial fan 230 along the transverse direction T and the high pressure exhaust region 268 is forward of axial fan 230 along the transverse direction T. That is, due to the blade configuration and rotation direction of axial fan 230 in the second direction, air is pulled from cooking chamber 116 through the first plurality of apertures 200 of top wall 121 and into duct 202. The air flows through duct 202 downstream to fan enclosure 204, and more particularly to the lower pressure suction region 266 of first region 226, which as noted above and shown in FIG. 16, is aft of axial fan 230 in the second cooking mode. The air from suction region 266 is passed to the exhaust region 268 through fan opening 262 of shroud 260. That is, the air flows right to left or in a forward direction along the transverse direction T from suction region 266 to exhaust region 268 through fan opening 262 of shroud 260. As noted above, shroud 260 creates and maintains the pressure differential between the suction region 266 and the exhaust region 268. The air at relatively high pressure within the exhaust region 268 flows out through the second plurality of apertures 210 and the plurality of intake/exhaust apertures 208 and back into cooking chamber 116 as shown in FIGS. 16 and 17. Notably, when air exits out of the second plurality of apertures 210 and the plurality of intake/exhaust apertures 208, the air exits substantially horizontally, and thus, the air initially contacts the food items within cooking chamber 116 horizontally.

As shown best in FIGS. 16 and 18, when radial fan 240 rotates about its axis of rotation, radial fan 240 moves air in through the plurality of intake apertures 216 of cover 206 and moves the air radially outward such that the air flows out through the first set of apertures 222 (FIG. 4) and the second set of apertures 224 (FIG. 4) of the third plurality of apertures 220 and back into cooking chamber 116. When air exits out of the third plurality of apertures 220, the air exits substantially horizontally, and thus, the air initially contacts the food items within cooking chamber 116 horizontally. Accordingly, in the second selected cooking mode, the airflow pattern includes a top airflow circuit that initially contacts the food substantially horizontally and a bottom airflow circuit that initially contacts the food substantially horizontally.

Figure 20:
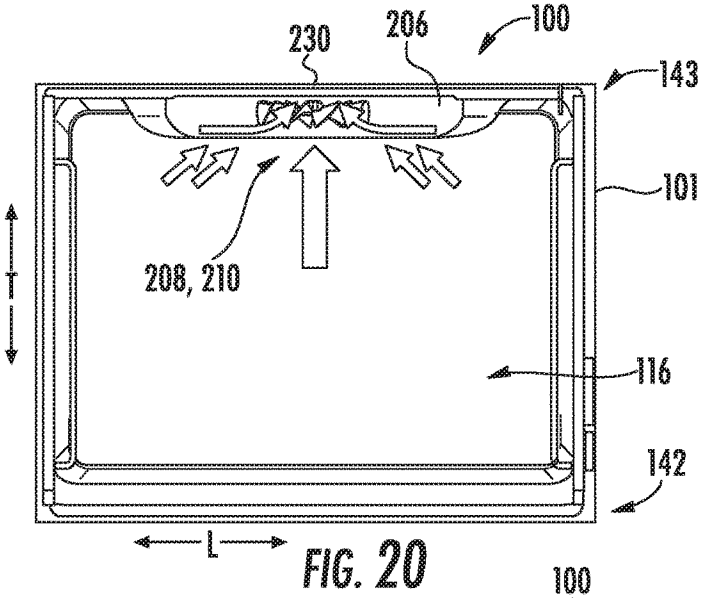
FIGS. 19, 20, and 21 depict a third airflow pattern associated with a third selected cooking mode.
Figure 21:
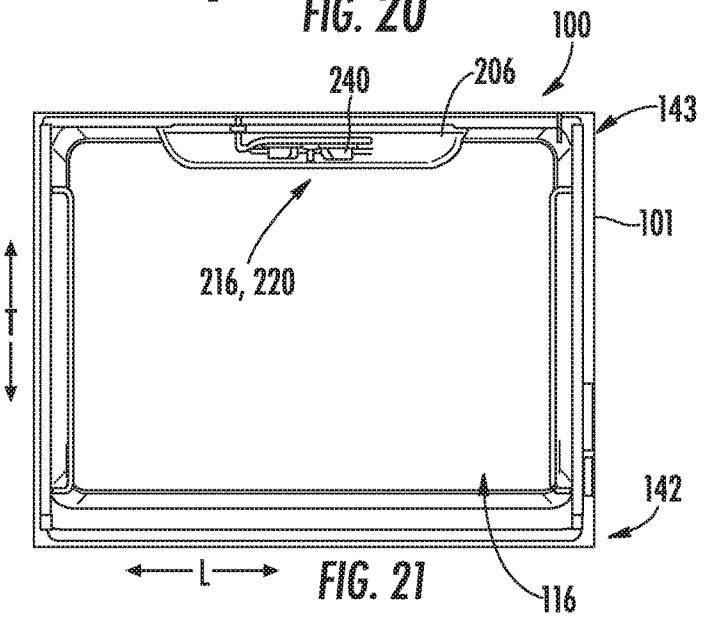
Figure 19:
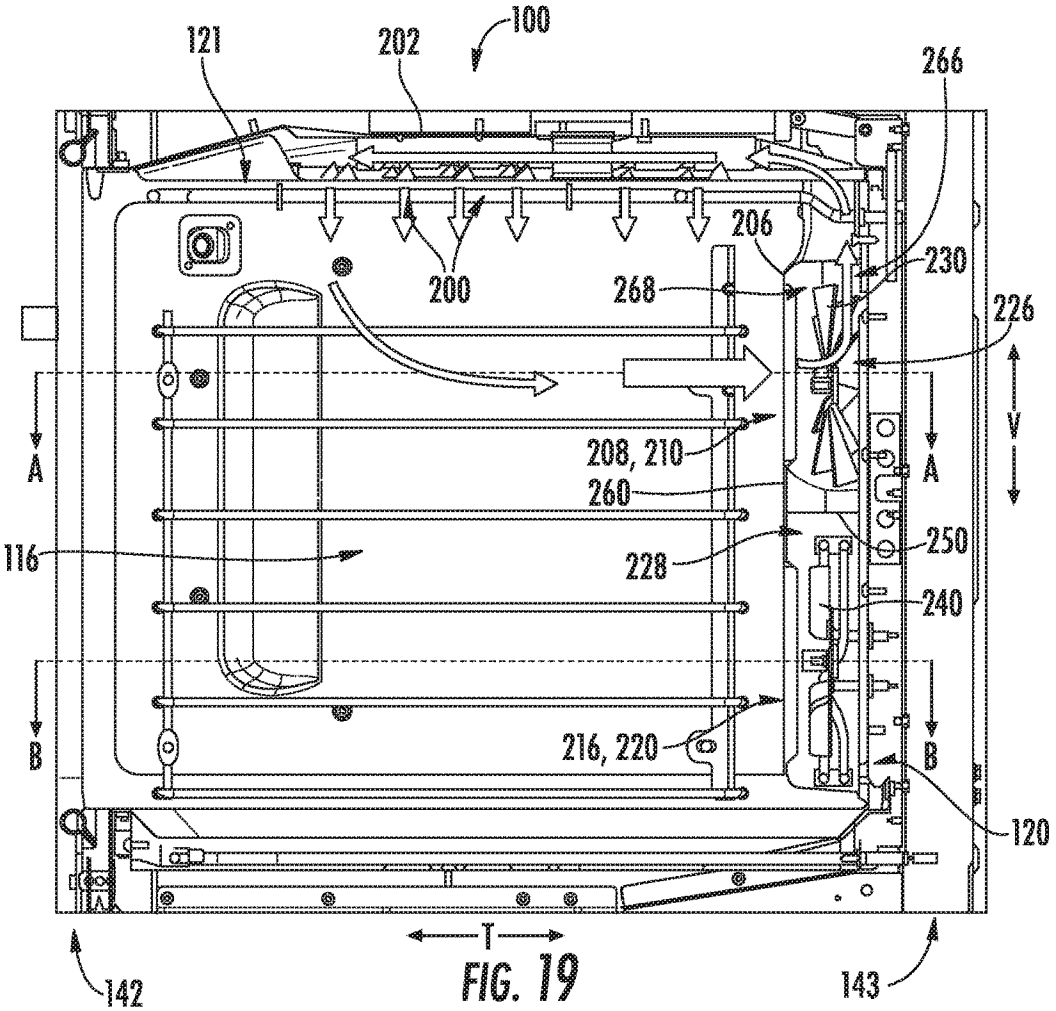

FIGS. 19, 20, and 21 depict a third airflow pattern generated by axial fan 230 and radial fan 240 within cooking chamber 116 when the third cooking mode is selected. FIG. 19 provides a schematic cross-sectional view of oven appliance 100 and depicts the third airflow pattern. FIG. 20 provides a top cross-sectional view of oven appliance 100 taken along the A-A axis of FIG. 19. FIG. 21 provides a top cross-sectional view of oven appliance 100 taken along the B-B axis of FIG. 19.

In the third cooking mode, like the first cooking mode, controller 160 sets the operation state of axial fan 230 such that axial fan 230 is in an on state and rotated in the first direction (e.g., CCW). As depicted in FIGS. 19 and 20, when axial fan 230 rotates about its axis of rotation in the first direction, axial fan 230 moves air out of the first plurality of apertures 200 defined by the top wall 121. More particularly, when axial fan 230 rotates about the axis of rotation in the first direction, axial fan 230 moves air from cooking chamber 116 into the intake/exhaust apertures 208 and the second plurality of apertures 210, and ultimately, the air flows out of the first plurality of apertures 200 defined by top wall 121 and back into cooking chamber 116 as shown in FIG. 19. Unlike the first cooking mode, in the third cooking mode controller 160 sets the operation state of radial fan 240 to an off state. Thus, as depicted in FIGS. 19 and 21, the radial fan 240 does not generate a bottom airflow circuit in the third cooking mode. Accordingly, in the third selected cooking mode, the third airflow pattern includes a top airflow circuit that initially contacts the food substantially vertically, and as radial fan 240 is in the off state in the third cooking mode, the third airflow pattern does not include a bottom airflow circuit that initially contacts the food substantially horizontally.

Figure 23:
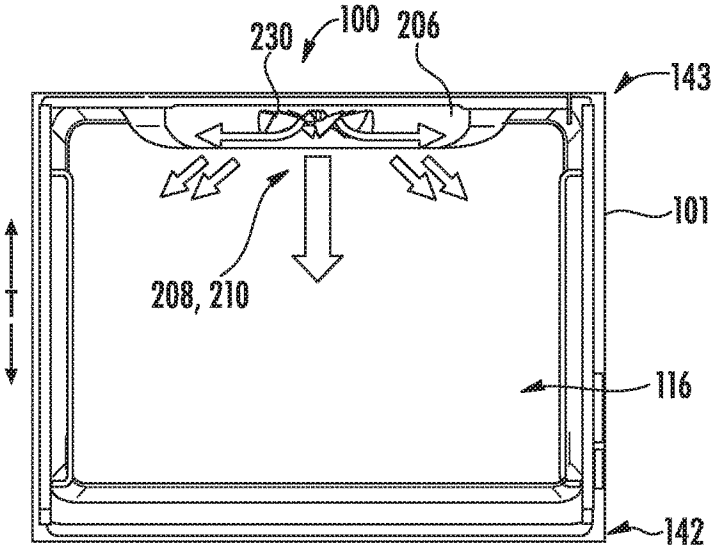
FIGS. 22, 23, and 24 depict a fourth airflow pattern associated with a fourth selected cooking mode.
Figure 24:
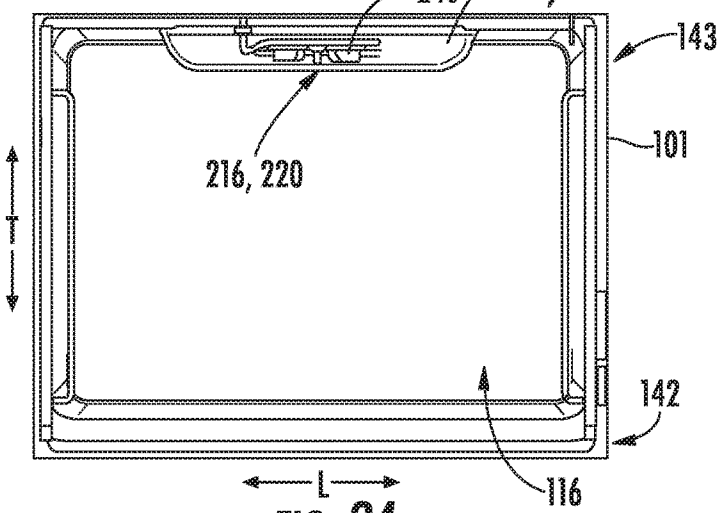
Figure 22:
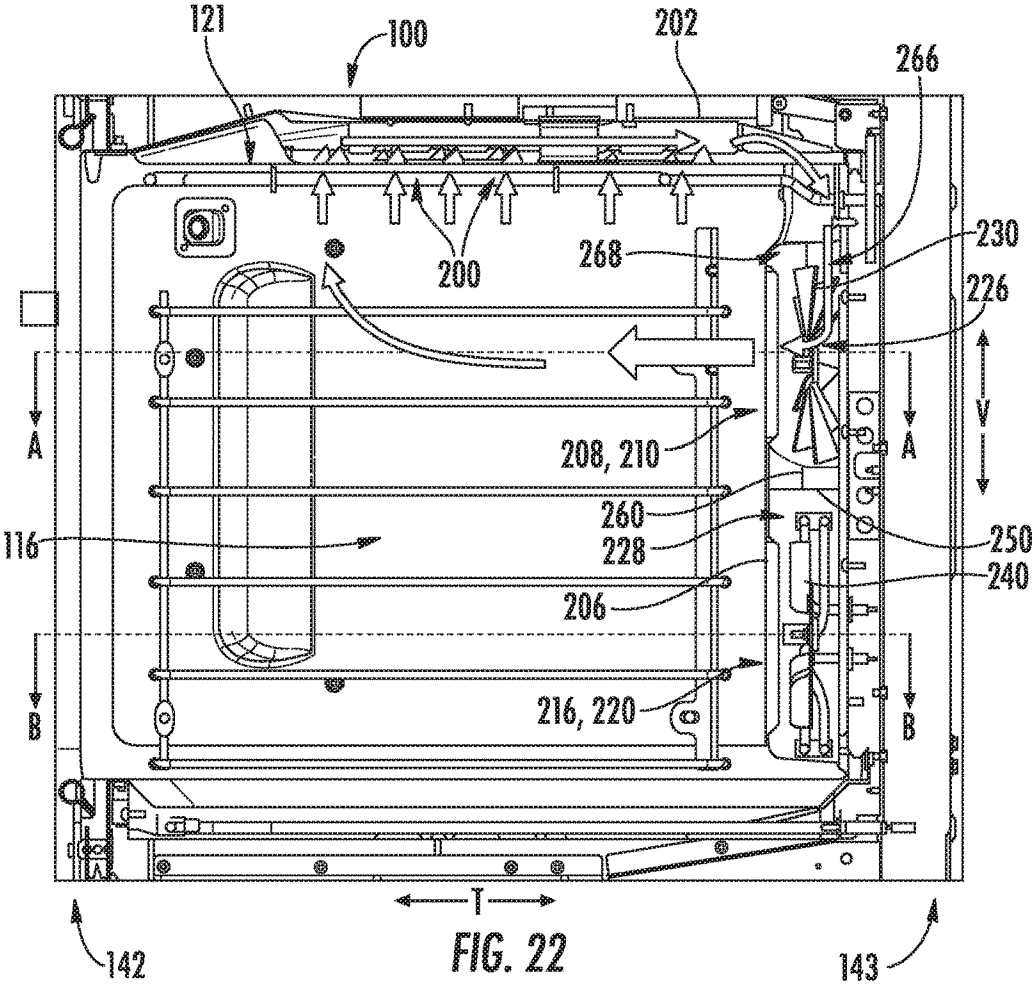

FIGS. 22, 23, and 24 depict a fourth airflow pattern generated by axial fan 230 and radial fan 240 within cooking chamber 116 when the fourth cooking mode is selected. FIG. 22 provides a schematic cross-sectional view of oven appliance 100 and depicts the fourth airflow pattern. FIG. 23 provides a top cross-sectional view of oven appliance 100 taken along the A-A axis of FIG. 22. FIG. 24 provides a top cross-sectional view of oven appliance 100 taken along the B-B axis of FIG. 22.

In the fourth cooking mode, like the second cooking mode, controller 160 sets the operation state of axial fan 230 such that axial fan 230 is in an on state and rotated in the second direction (e.g., CW). As depicted in FIGS. 22 and 23, when axial fan 230 rotates about its axis of rotation in the second direction, axial fan 230 moves air out of the second plurality of apertures 210 defined by cover 206. More specifically, when axial fan 230 rotates about the axis of rotation in the second direction, axial fan 230 moves air from cooking chamber 116 into the first plurality of apertures 200 defined by top wall 121 and out of the first set of apertures 212 and the second set of apertures 214 of the second plurality of apertures 210 and the plurality of intake/exhaust apertures 208 defined by cover 206 and back into cooking chamber 116.

Unlike the second cooking mode, in the fourth cooking mode controller 160 sets the operation state of radial fan 240 to an off state. Thus, as depicted in FIGS. 22 and 24, the radial fan 240 does not generate a bottom airflow circuit in the fourth cooking mode. Accordingly, in the fourth selected cooking mode, the fourth airflow pattern includes a top airflow circuit that initially contacts the food substantially horizontally, and as radial fan 240 is in the off state in the fourth cooking mode, the fourth airflow pattern does not include a bottom airflow circuit that initially contacts the food substantially horizontally.

Figure 26:
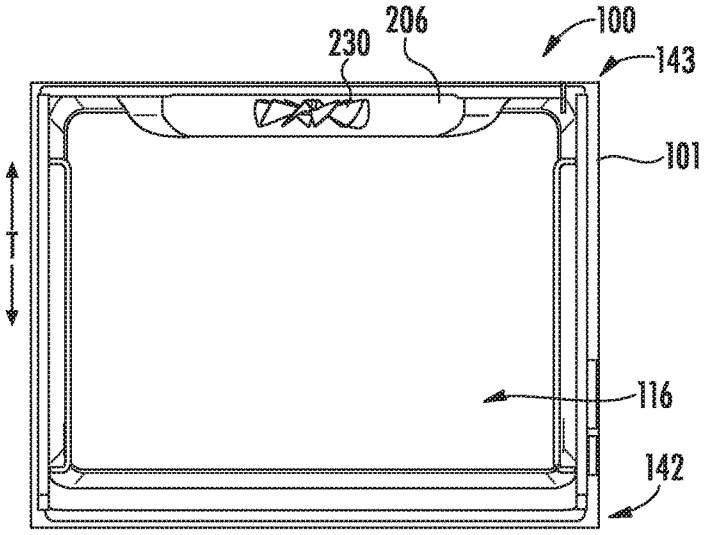
FIGS. 25, 26, and 27 depict a fifth airflow pattern associated with a fifth selected cooking mode.
Figure 27:
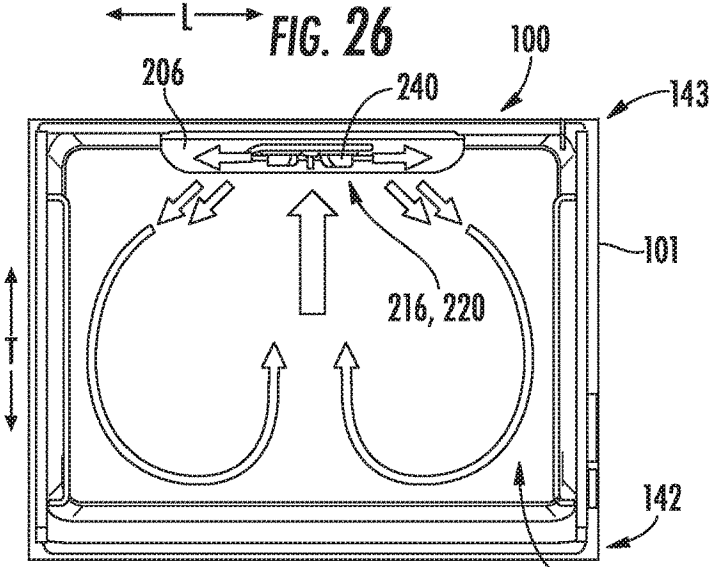
Figure 25:
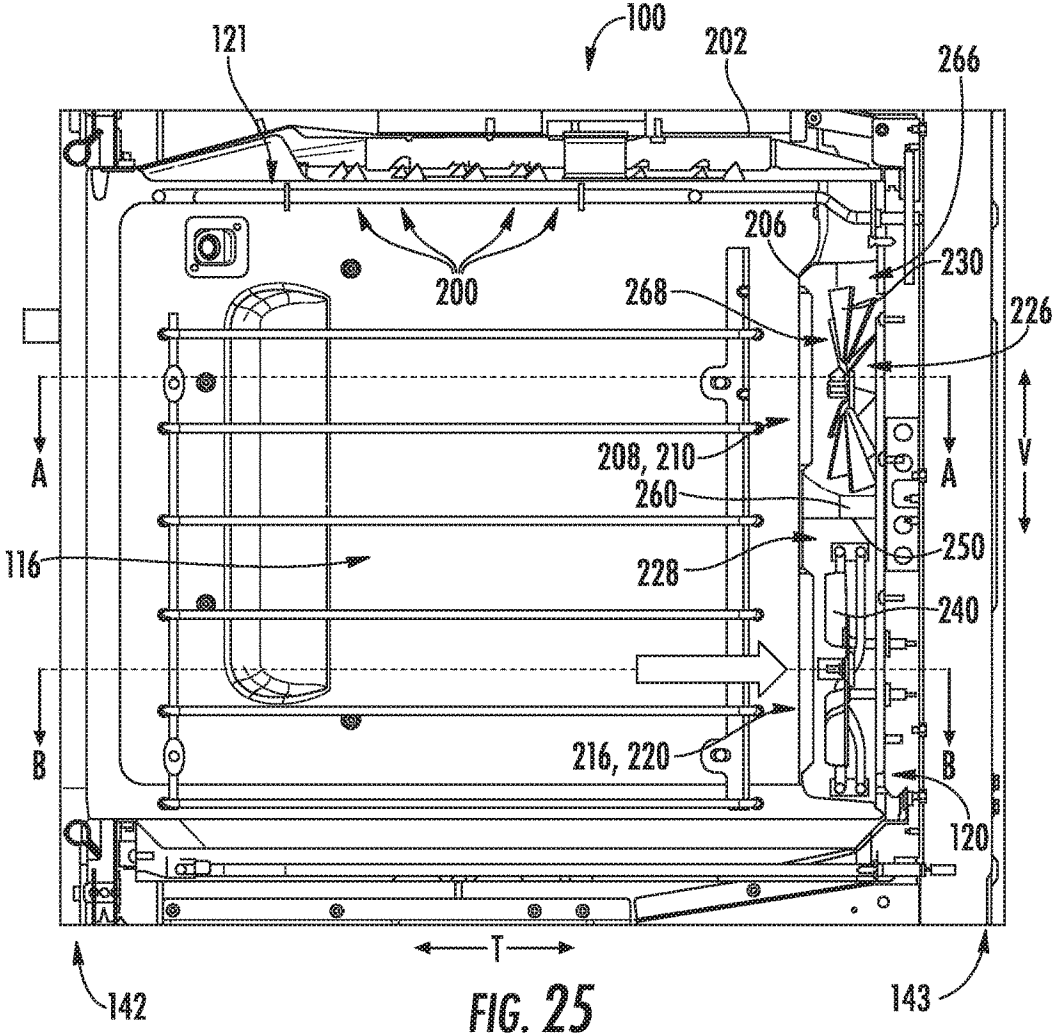

FIGS. 25, 26, and 27 depict a fifth airflow pattern generated by axial fan 230 and radial fan 240 within cooking chamber 116 when the fifth cooking mode is selected. FIG. 25 provides a schematic cross-sectional view of oven appliance 100 and depicts the fifth airflow pattern. FIG. 26 provides a top cross-sectional view of oven appliance 100 taken along the A-A axis of FIG. 25. FIG. 27 provides a top cross-sectional view of oven appliance 100 taken along the B-B axis of FIG. 25.

In the fifth cooking mode, controller 160 sets the operation state of axial fan 230 such that axial fan 230 is in an off state and radial fan 240 is in an on state. Thus, as depicted, radial fan 240 generates a bottom airflow circuit and axial fan 230 does not generate a top airflow circuit in the fifth cooking mode. Accordingly, in the fifth selected cooking mode, the fifth airflow pattern includes a bottom airflow circuit that initially contacts the food substantially horizontally, and as axial fan 230 is in the off state in the fifth cooking mode, the fifth airflow pattern does not include a top airflow circuit.

As described above and depicted in FIGS. 13 through 27, oven appliance 100 can generate at least five distinct airflow patterns by operating axial fan 230 and radial fan 240 in different operation modes and directions. Accordingly, the oven appliance 100 of the present disclosure can circulate air in patterns that are suited to more food types and placements than existing systems, which can result in enhanced cooking performance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet having a top wall, a bottom wall, a back wall, and opposing sidewalls defining a chamber, the chamber configured for receipt of food items for cooking, the top wall defining a first plurality of apertures in fluid communication with the chamber;

a cover mounted to the back wall and defining a second plurality of apertures and a third plurality of apertures, the cover and the back wall defining a fan enclosure, the second plurality of apertures and the third plurality of apertures providing fluid communication between the chamber and the fan enclosure;

a duct providing fluid communication between the fan enclosure and the first plurality of apertures defined by the top wall;

an axial fan positioned in the fan enclosure and operable to move air out of either the first plurality of apertures or the second plurality of apertures based at least in part on a selected cooking mode;

a radial fan positioned in the fan enclosure and operable to move air out of the third plurality of apertures based at least in part on the selected cooking mode;

a divider positioned between the axial fan and the radial fan, the divider separating the fan enclosure into a first region and a second region; and a shroud having a vertical plate defining a fan opening in which the axial fan is positioned, the vertical plate separating the fan enclosure into a first pressure region forward of the axial fan and a second pressure region rearward of the axial fan, and wherein the vertical plate of the shroud is mounted to or seated on the divider.

2. The oven appliance of claim 1, wherein the oven appliance defines a transverse direction, and wherein the vertical plate of the shroud extends in a plane orthogonal to the transverse direction and is aligned with the axial fan along the transverse direction T.

3. The oven appliance of claim 1, wherein the oven appliance defines a transverse direction and a vertical direction, the first region and the second region being separated from one another by the divider along the vertical direction.

4. The oven appliance of claim 1, wherein the oven appliance defines a vertical direction, and wherein the second plurality of apertures are defined by the cover above the divider along the vertical direction and the third plurality of apertures are defined by the cover below the divider along the vertical direction.

5. The oven appliance of claim 1, wherein the oven appliance defines a vertical direction, and wherein the axial fan is positioned above the radial fan along the vertical direction.

6. The oven appliance of claim 1, wherein the axial fan is rotatable about an axis of rotation in a first direction and a second direction, the second direction being opposite to the first direction, and wherein when the axial fan rotates about the axis of rotation in the first direction, the axial fan moves air out of at least one aperture of the first plurality of apertures defined by the top wall, and wherein when the axial fan rotates about the axis of rotation in the second direction, the axial fan moves air out of at least one aperture of the second plurality of apertures defined by the cover.

7. The oven appliance of claim 6, wherein the oven appliance defines a vertical direction, a lateral direction, and a transverse direction mutually perpendicular to one another, and wherein the cover defines a plurality of intake/exhaust apertures aligned with the axial fan along the lateral direction and the vertical direction, and wherein the second plurality of apertures include a first set of apertures and a second set of apertures located on opposite sides of the plurality of intake/exhaust apertures, and wherein when the axial fan rotates about the axis of rotation in the first direction, the axial fan moves air from the chamber into at least one aperture of the intake/exhaust apertures and at least one aperture of the second plurality of apertures and out of at least one aperture of the first plurality of apertures defined by the top wall and into the chamber, and wherein when the axial fan rotates about the axis of rotation in the second direction, the axial fan moves air from the chamber into at least one aperture of the first plurality of apertures defined by the top wall and out of at least one aperture of the first set of apertures and at least one aperture of the second set of apertures of the second plurality of apertures and at least one aperture of the plurality of intake/exhaust apertures defined by the cover and into the chamber.

8. The oven appliance of claim 1, wherein the oven appliance defines a vertical direction, a lateral direction, and a transverse direction mutually perpendicular to one another, and wherein the cover defines a plurality of intake apertures aligned with the radial fan along the lateral direction and the vertical direction, and wherein the third plurality of apertures include a first set of apertures and a second set of apertures located on opposite sides of the plurality of intake apertures along the lateral direction, and wherein the radial fan is operable to move air in through the plurality of intake apertures and move the air out through the first set of apertures and the second set of apertures and into the chamber based at least in part on the selected cooking mode.

9. The oven appliance of claim 1, further comprising:

a controller configured to:

receive an input indicating the selected cooking mode;

set an operation state of the axial fan and an operation state of the radial fan based at least in part on the selected cooking mode; and in response to the set operation state of the axial fan and the radial fan, cause at least one of:

i) the axial fan to move air out of either the first plurality of apertures or the second plurality of apertures based at least in part on the set operation state of the axial fan; and ii) the radial fan to move air out of the third plurality of apertures based at least in part on the set operation state of the radial fan.

10. The oven appliance of claim 9, wherein in setting the operation state of the axial fan, the controller is configured to:

toggle the axial fan to an on state; and set a rotation direction of the axial fan about an axis of rotation.

11. The oven appliance of claim 9, wherein the oven appliance is operable in at least five selectable cooking modes, wherein for each of the selectable cooking modes, the axial fan and the radial fan are configured to produce a distinct airflow pattern within the chamber.

12. An oven appliance defining a vertical direction, a lateral direction, and a transverse direction mutually perpendicular to one another, the oven appliance comprising:

a cabinet having a top wall, a bottom wall, a back wall, and opposing sidewalls defining a chamber, the chamber configured for receipt of food items for cooking, the top wall defining a first plurality of apertures in fluid communication with the chamber;

a heating element for providing heat to the chamber;

a cover mounted to the back wall and defining a second plurality of apertures and a third plurality of apertures, the cover and the back wall defining a fan enclosure, the second plurality of apertures and the third plurality of apertures providing fluid communication between the chamber and the fan enclosure;

a duct providing fluid communication between the fan enclosure and the first plurality of apertures defined by the top wall;

a first fan;

a second fan;

a divider positioned between the first fan and the second fan along the vertical direction, the divider separating the fan enclosure into a top region in which the first fan is positioned and a bottom region in which the second fan is positioned, the top region being in fluid communication with the first plurality of apertures and the second plurality of apertures and the bottom region being in fluid communication with the third plurality of apertures; and a shroud having a vertical plate defining a fan opening in which the axial fan is positioned, the vertical plate separating the fan enclosure into a first pressure region forward of the axial fan and a second pressure region rearward of the axial fan, and wherein the vertical plate of the shroud is mounted to or seated on the divider.

13. The oven appliance of claim 12, wherein the first fan is an axial fan and the second fan is a radial fan.

14. The oven appliance of claim 12, wherein the vertical plate of the shroud extends in a plane orthogonal to the transverse direction and is aligned with the axial fan along the transverse direction T.

15. The oven appliance of claim 12, wherein the first fan is rotatable about an axis of rotation in a first direction and a second direction, the second direction being opposite of the first direction.

16. A method of operating an oven appliance, the method comprising:

receiving, by a controller of the oven appliance, an input indicating a selected convection cooking mode;

causing, by the controller, at least one of a first fan and a second fan to move air within a cooking cavity defined by a cabinet of the oven appliance based at least in part on the selected convection cooking mode, and wherein when the first fan is caused to move air within the cooking chamber, the first fan moves air out of either a first plurality of apertures defined by a top wall of the cabinet or a second plurality of apertures defined by a cover based at least in part on the selected convection cooking mode, the cover defining a fan enclosure in which the first fan is positioned; and wherein when the second fan is caused to move air within the cooking chamber, the second fan moves air out of the third plurality of apertures based at least in part on the selected convection cooking mode, the second fan being positioned within the fan enclosure; and wherein the oven appliance includes a shroud having a vertical plate defining a fan opening in which the first fan is positioned, the vertical plate separating the fan enclosure into a first pressure region forward of the first fan and a second pressure region rearward of the first fan, and wherein the vertical plate of the shroud is mounted to or seated on a divider positioned between the first fan and the second fan along a vertical direction, the divider separating the fan enclosure into a top region in which the first fan is positioned and a bottom region in which the second fan is positioned, the top region being in fluid communication with the first plurality of apertures and the second plurality of apertures and the bottom region being in fluid communication with the third plurality of apertures.

17. The method of claim 16, wherein the first fan is an axial fan and the second fan is a radial fan.

18. The method of claim 17, wherein the oven appliance defines a transverse direction, and wherein the vertical plate of the shroud extends in a plane orthogonal to the transverse direction and is aligned with the first fan along the transverse direction T.

* * * * *